United States Patent [19]

Fleischer

[11] 4,093,512

[45] June 6, 1978

[54] PAPERMAKERS BELTS HAVING ULTRA-HIGH MODULUS LOAD BEARING YARNS

[75] Inventor: Thomas B. Fleischer, East Greenbush, N.Y.

[73] Assignee: Huyck Corporation, Wake Forest, N.C.

[21] Appl. No.: 571,031

[22] Filed: Apr. 23, 1975

[51] Int. Cl.[2] ..... D21F 1/10; D21F 7/08

[52] U.S. Cl. ..... 162/348; 139/383 A; 139/420 R; 139/420 D; 139/422; 139/425 A; 162/358; 162/DIG. 1; 428/259; 428/377

[58] Field of Search ..... 162/289, 348, 358, DIG. 1; 428/230, 231, 257, 258, 259, 920, 377; 139/383 A, 420 R, 420 D, 422, 425 A; 260/78 R

[56] References Cited

U.S. PATENT DOCUMENTS

| | | | |
|---|---|---|---|
| 3,049,153 | 8/1962 | Jones | 139/383 A |
| 3,158,984 | 12/1964 | Butler | 162/DIG. 1 |
| 3,248,802 | 5/1966 | Wagner | 139/383 A |
| 3,421,230 | 1/1969 | Ward | 162/348 X |
| 3,622,431 | 11/1971 | Turcksin | 428/377 |
| 3,817,941 | 6/1974 | Bair et al. | 260/78 R |

OTHER PUBLICATIONS

"1975 Man-Made Fiber Deskbook," Modern Textile Magazine, Mar. 1975, pp. 17 and 26.

*Primary Examiner*—Richard V. Fisher
*Attorney, Agent, or Firm*—Sanford S. Wadler

[57] ABSTRACT

Generally, this invention relates to papermakers' belts for use in papermaking machines which comprise ultra high modulus load bearing yarn comprised of poly(-para-phenylene terephthalamide).

16 Claims, 9 Drawing Figures

FIG. 8
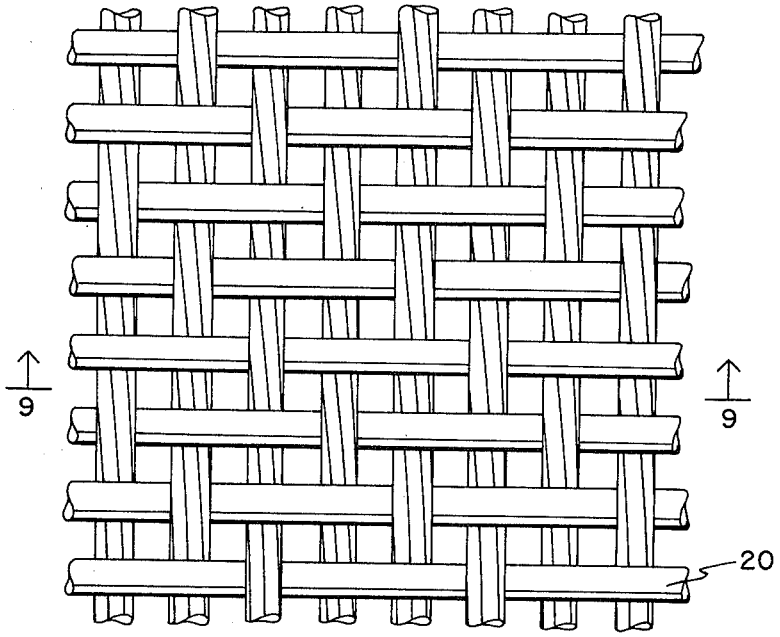
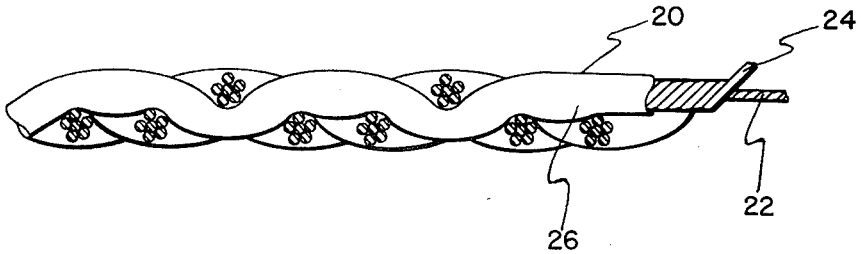
FIG. 9

PAPERMAKERS BELTS HAVING ULTRA-HIGH MODULUS LOAD BEARING YARNS

BACKGROUND FOR THE INVENTION

Previously, papermakers' belts for use in the forming section of a papermaking machine have been made with metal warps since such strands are resistant to stretch. However, they have not continued to be widely used because they are subject to damage as a result of crinkling or creasing during shipment and installation. Also, such belts have low flexural fatigue resistance as compared to synthetic belts.

In order to attempt to overcome the forementioned problems synthetic papermakers' forming fabrics were introduced into the papermaking field. Such fabrics have incorporated relatively low modulus load bearing yarns made of nylon, polyester, rayon and the like. By low modulus yarns or material it is meant yarns or material having a modulus of elasticity of less than 150 grams per denier measured as defined herein. However, problems have occurred using such fabrics in some papermaking applications where such fabrics are subjected to high longitudinal tension causing high drag and with resulting stretch in the longitudinal direction. For example, since the forming fabrics transmit energy from the drive roll to the drainage elements and other rotating and stationary parts of the forming section of the papermaking machine, it is essential that such fabrics possess a high degree of resistance to stretch in order to prevent power losses resulting from the belt slipping or creeping on the drive roll. Further, excessive stretch may result in the fabric "running" off the rolls of the papermaking machine causing a consequent loss of papermaking machine use time. Even relatively minor stretching of papermaking fabrics results in various operational problems such as increased wear. Consequently, it has been a long-sought objective in the papermaking art to produce belts which are resistant to stretching.

Unexpectedly, it has been found that by using ultra high modulus yarns as the load bearing yarns of a papermakers' fabric it is possible to obtain advantages not before possible. By load bearing is meant those yarns which extend in the machine or longitudinal direction which is the direction of travel of the belt. In the context of the present invention by ultra high modulus yarns or material it is meant yarns or material comprised of an organic polymer and having a modulus of elasticity greater than 150 grams per denier as measured at 1% elongation (using zero % elongation as a reference point) by dividing the force in grams per denier at 1% elongation by 0.01. Papermakers' belts incorporating such ultra high modulus yarns as load bearing yarns are substantially stretch resistant in the machine direction even when subjected to high tension applications, and may have an extensibility in the range of less than 0.40% and may be as low as 0.18% or less, making it possible to produce a belt having better wear characteristics and an increase in the overall efficiency of the papermaking operation. In addition, the use of ultra high modulus yarns as load bearing yarns allows for reduction relative to prior art papermakers' belts of the diameter of the load bearing yarns, or number of machine direction or load bearing yarns per inch of width, needed to insure adequate dimensional stability and stretch resistance. Such a reduction in the number or diameter of load bearing yarns per inch of width permits an increase in the number of non-load bearing yarns per inch of length. By non-load bearing yarns is meant those yarns which extend in a direction transverse to the load bearing or machine direction yarns. By increasing the number of non-load bearing yarns per inch and decreasing the number of load bearing yarns per inch it is possible to produce a belt the interstices of which are more square than prior art synthetic papermakers belts since a belt may be produced having a more equal number of warp and weft yarns per square unit of the belt. Belts which are more square have better pulp fiber retention as well as desirable wear characteristics and transverse or cross machine direction stability. The desirable wear characteristics mentioned result from the use of additional wear, non-load bearing transverse yarns permitted by a reduction in the diameter or number of load bearing machine direction yarns needed which can be achieved when ultra high modulus load bearing yarns are used. This also allows for an increase in the cross machine direction stability because the number of cross machine direction or non-load bearing yarns in the belt can be increased. Other desirable operational characteristics which are enhanced by the use of ultra high modulus yarns are a more uniform support of the paper sheet since the fabric is more square and therefore there is less marking of the paper sheet. If desired smaller diameter ultra high modulus yarns can be used so as to produce a belt having smaller interstices and hence even greater pulp fine retention and sheet support as well as less sheet marking than structures using ultra high modulus yarn diameters equivalent to those normally used in papermakers' belts.

Further, to the extent that it is possible to reduce the number of load bearing yarns per inch of width loom productivity may be increased effecting cost savings in the production of belts incorporating such yarns.

Thus it is an object of this invention to provide a papermakers' belt comprising ultra high modulus load bearing yarns.

It is a further object of this invention to provide a papermakers belt having stretch resistance.

It is a still further object of this invention to provide a papermakers' belt which is more square and in which the number and diameter of load bearing yarns can be reduced and the number of wear bearing yarns increased.

Another object of the present invention is to provide a papermakers' belt having improved wear characteristics and better retention of pulp fibers.

A still other object of the invention is to provide a means of increasing loom productivity.

A further object of the present invention is to provide a belt having desirable dimensional stability.

A still further object of the present invention is to provide a fabric with reduced tendency to mark the sheet.

SUMMARY OF THE INVENTION

These and other objects, as will be apparent to those skilled in the art, may be achieved from the practice of the present invention one embodiment of which is a papermakers' belt comprising ultra high modulus load bearing yarns having a modulus of elasticity greater than 150 grams per denier. The ultra high modulus yarns used in the present invention may be resin coated or wrapped or wrapped and then resin coated so as to improve their abrasion resistance or degradation resistance or to impart other desirable qualities into the load bearing yarn structure.

An understanding of this invention may be had from the detailed discussion which follows and from an examination of the drawings in which:

FIG. 8 is a fragmentary plan view of a further embodiment of the present invention.

FIG. 9 is a sectional view along the line 9—9 in FIG. 8.

DESCRIPTION OF THE PREFERRED EMBODIMENTS

Figure 1:
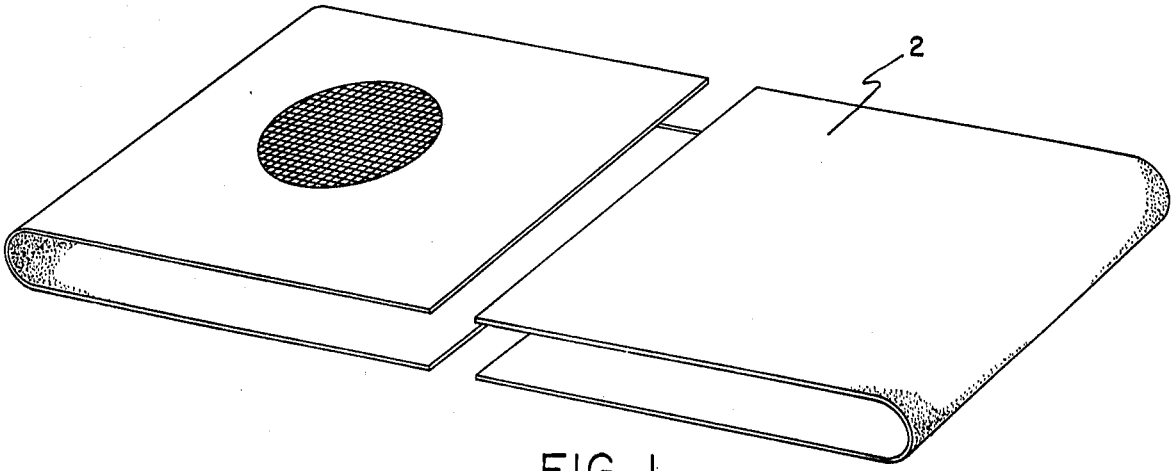
FIG. 1 is a perspective view of a papermakers belt embodying the present invention.
Figure 2:
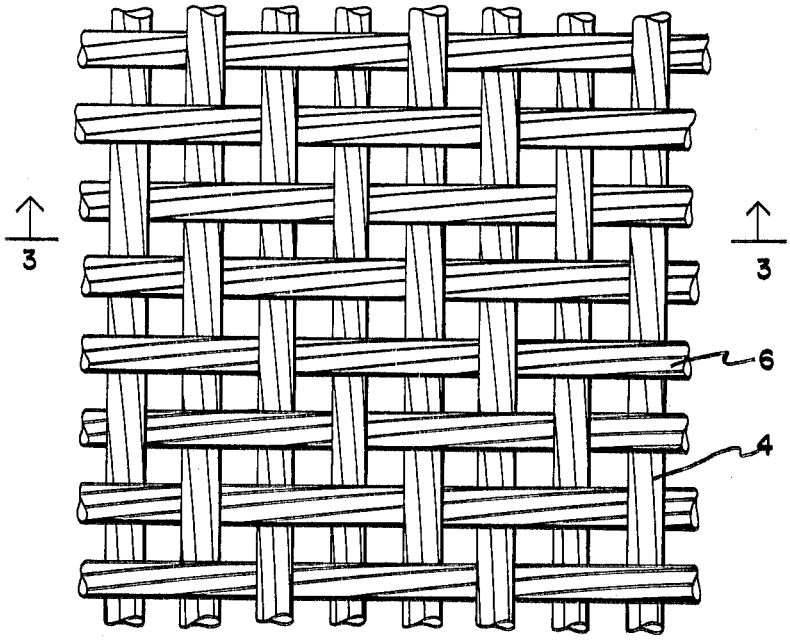
FIG. 2 is a fragmentary plan view of a portion of the papermakers' belt of FIG. 1.
Figure 3:
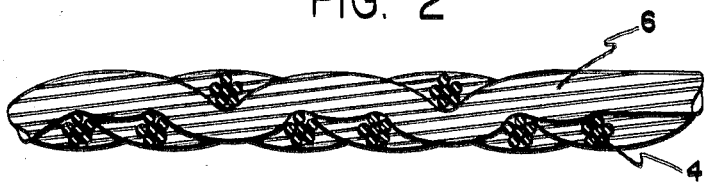
FIG. 3 is a sectional view along the line 3—3 in FIG. 2.
Figure 6:
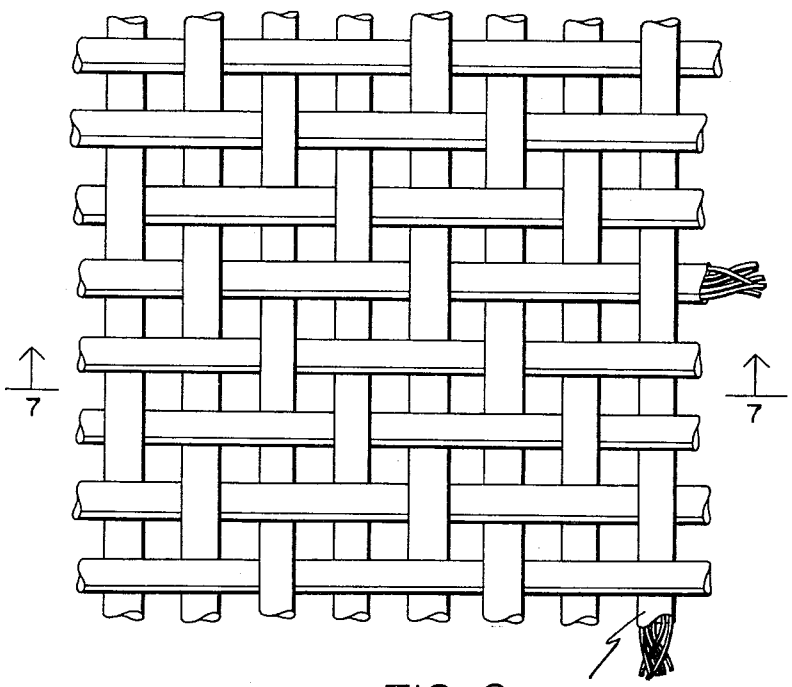
FIG. 6 is a fragmentary plan view of another embodiment of the present invention.
Figure 7:
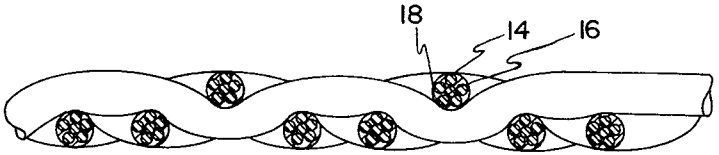
FIG. 7 is a sectional view along the line 7—7 in FIG. 6.

Illustrated in FIG. 2 is a fragmentary plan view of a portion of the papermakers' belt 2 in FIG. 1 in which the yarns 4 are the load bearing or machine direction yarns and are ultra high modulus yarns having a modulus of elasticity greater than 150 gram per denier. It is understood that the term papermakers' belts as used herein includes forming fabrics, dryer fabrics and felts, and press fabrics and felts, and the like, and includes such fabrics and felts which are endless woven or are woven flat and then joined at either end to form a conveyor belt-like structure. Alternatively, such felts and fabrics can be nonwoven, as for example, the papermakers felt described and claimed in Fekete, U.S. Pat. No. 3,392,079. Any ultra high modulus yarn structure comprised of organic polymer in the form of yarn or fiber, multifilament, monofilament or staple yarns or fibers, and the like, may be used as the load bearing yarns and the recitation of specific materials, fibers, yarns and the like is not meant to limit the scope or range of the invention. For example, synthetic fibers such as Kevlar 29 manufactured by E. I. DuPont De Nemours & Company have been found suitable for use in the present invention. Kevlar and Kevlar 29 are trademarks of E. I. DuPont de Nemours & Co. for synthetic fibers which comprise poly(para-phenylene terephthalamide). However, generally, any yarns having a modulus of elasticity greater than 150 gram per denier and possessing the necessary flexural fatigue resistance and non-self abrasiveness are suitable for use as load bearing yarns in the practice of the present invention.

The non-load bearing yarns 6 may be ultra high modulus yarns but usually will be in the form of low modulus staple or monofilament or multifilament yarns and may comprise by way of example only synthetic materials and/or natural fibers. Such low modulus yarns may comprise synthetic materials such as, for example, polyamides, polyesters or acrylics or natural fibers such as, for example, wool or cotton, or combinations of such synthetic and/or natural yarns. In many high tension applications such materials are not desirable for use as load bearing yarns in the machine direction since they are subject to stretch which will result in such problems as belt stretch and reduced papermaking machine efficiency.

Papermakers belts of the present invention may be woven from a variety of weave patterns. Useful weave patterns are twill, plain, duplex, and satin weave configurations although other weave patterns may also be operative. The fabrics depicted in the drawings embody a twill weave.

Figure 4:
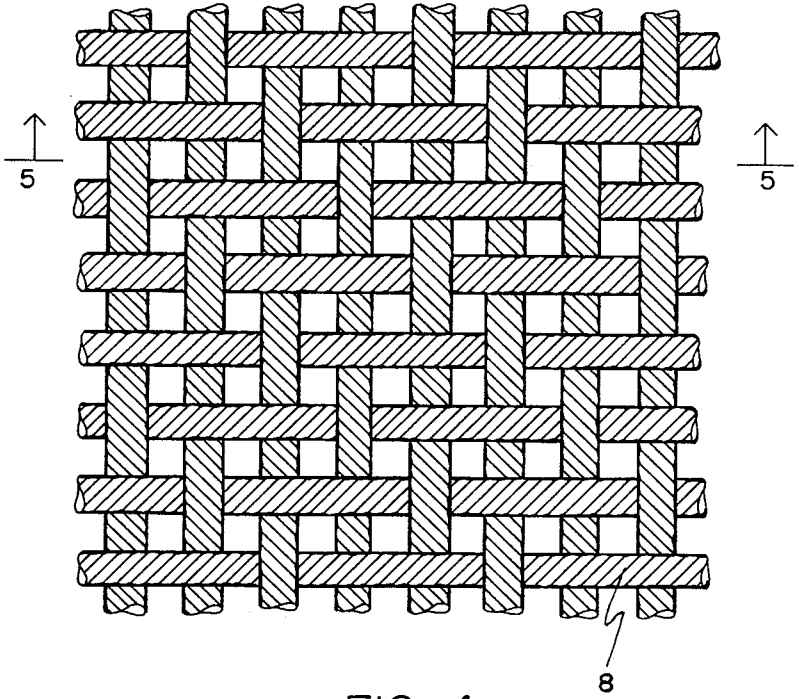
FIG. 4 is a fragmentary plan view of a further embodiment of the present invention.
Figure 5:
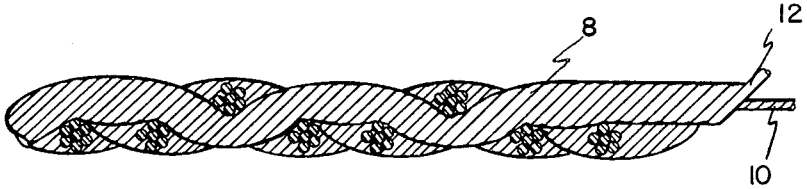
FIG. 5 is a sectional view along the line 5—5 in FIG. 4.

The load bearing yarns 8 shown in FIGS. 4 and 5 have a high modulus synthetic core material 10 around which is wrapped a cover material 12 which provides for degradation resistance and/or wear resistance. One example of a cover material 12 is asbestos which is highly resistant to heat and acids. Nylon or dacron would also be useful in certain applications for covering the core yarn 10 since these materials have excellent wear resistance. Although the forementioned materials are suitable for their intended applications their recitation is not meant to limit the range of materials which may be found useful in the practice of the present invention.

Illustrated in FIGS. 6 to 9 are different views of a papermakers belt comprising resin coated load bearing yarns of the type which would be useful as embodiments of the present invention. The core yarns of such belts may be coated without applying a wrapping or cover material, or may be coated prior to being wrapped by a cover material, or a resin coating may be applied after the core yarn has been wrapped by a cover material. For example, the portion of the belt depicted in FIGS. 6 and 7 comprises load bearing yarns 14 comprising multifilament core yarns 16 which have been coated with a resin 18. The portion of the belt depicted in FIGS. 8 and 9 comprises load bearing yarns 20 comprising multifilament core yarns 22, wrapping or cover material 24 and resin coating 26.

By way of example only and without any intention to limit the scope of resins which may be used in the present invention, such resins may be used as nylon resins, water based acrylics of which two examples are Rhoplex AC201 (produced by Rohn and Haas) and Hycar 2600 × 172 (produced by B. F. Goodrich). Phenolic resins and amino resins such as American Cyanamids Aerotex M-3 are also suitable for use in practicing the present invention. A desirable coating method may be to use a two step resin treatment first applying a thermosetting acrylic resin and then a phenolic resin. A suitable method and apparatus for applying the resin is described in Christie et al, U.S. Pat. Nos. 3,252,821 and 3,149,003.

EXAMPLE

A papermakers' belt was woven endless having a four-harness satin weave and comprising 65 weft or machine direction yarns per inch and 40 warp or cross machine direction yarns per inch. The load bearing multifilament weft yarns comprised ultra high modulus Kevlar 29 fibers which had been S twisted at the rate of 12 twists per inch and which had a modulus of elasticity of about 450 grams per denier. The papermakers belt was positioned upon treating equipment of the type described in U.S. Pat. Nos. 3,252,821 and 3,149,003 and subjected to a two stage resin treatment comprising a combination of acrylic/phenolic resins as follows. An acrylic resin containing 7% resin solids was applied to the belt and allowed to dry at 160° to 170° F. Subsequent to the application of the acrylic resin, a phenolic resin containing 7% resin solids was applied to the belt and the papermakers belt was cured at 380° to 400° F. The resin treatment was applied after the belt was woven and resulted in a resin pick-up in the amount of about 12.8% of the weight of the untreated belt. When the fabric was removed from the finishing equipment it comprised 40 warps per inch and 74 wefts per inch.

When run on the forming section of a papermaking machine at a return belt tension of about 25 pounds per linear inch of width the belt described above exhibited an extensibility of only about 0.25%.

It will be apparent to those skilled in the art that the present invention may be practiced in a wider variety of embodiments without materially departing from the spirit and scope of the invention. It is also to be understood that in the foregoing specification, specific embodiments and components thereof which have been illustrated and discussed by way of illustration only and not of limitation and that this invention may be practiced by those skilled in the art utilizing a wide variety of materials and configurations without departing from the true spirit of the invention.

I claim:

1. A papermakers' belt for use in a papermaking machine and comprised of ultra-high modulus load-bearing yarns comprised of poly (para-phenylene terephthalamide).

2. A papermakers belt as recited in claim 1 wherein said load bearing yarns are resin coated.

3. A papermakers belt as recited in claim 1 wherein said load bearing yarns are wrapped.

4. A papermakers belt as recited in claim 3 wherein said wrapped yarns are resin coated.

5. A papermakers belt as recited in claim 3 wherein said yarns are wrapped with asbestos.

6. A papermakers belt as recited in claim 3 wherein said yarns are wrapped with nylon.

7. A papermakers belt as recited in claim 3 wherein said yarns are wrapped with acrylic.

8. A papermakers' belt for use in a papermaking machine and comprising ultra-high modulus load-bearing yarns comprised of poly (para-phenylene terephthalamide) and non-load bearing yarns having a modulus of elasticity less than 150 grams per denier.

9. A papermakers belt as recited in claim 8 wherein said load bearing yarns are resin coated.

10. A papermakers' belt as recited in claim 8 wherein said non-load bearing yarns are multifilament polyester.

11. A papermakers' belt as recited in claim 8 wherein said non-load bearing yarns are monofilament polyester.

12. A papermakers' belt for use in a papermaking machine and comprising ultra-high modulus load bearing yarns which are coated with nylon resin and comprise multifilament poly(para-phenylene terephthalamide) fibers, and the non-load bearing yarns comprise multifilament polyester having a modulus of elasticity less than 150 grams per denier.

13. A papermakers belt as recited in claim 12 wherein said load bearing yarns are wrapped.

14. A papermakers' belt for use in a papermaking machine and comprising ultra-high modulus load bearing yarns which are coated with nylon resin and comprise multifilament poly(para-phenylene terephthalamide) fibers, and the non-load bearing yarns comprise multifilament nylon having a modulus of elasticity less than 150 grams per denier.

15. A papermakers' belt for use in a papermaking machine and comprising ultra-high modulus load bearing yarns which are coated with nylon resin and comprise multifilament poly(para-phenylene terephthalamide) fibers, and the non-load bearing yarns comprise monofilament nylon having a modulus of elasticity less than 150 grams per denier.

16. A papermakers' belt woven in a four-harness satin weave for use in a papermaking machine and comprising ultra-high modulus load-bearing yarns comprised of poly (para-phenylene terephthalamide), and wherein said belt is resin-coated.

* * * * *